US005646515A

United States Patent [19]

Mayes et al.

[11] Patent Number: 5,646,515

[45] Date of Patent: Jul. 8, 1997

[54] RATIOED REFERENCE VOLTAGE GENERATION USING SELF-CORRECTING CAPACITOR RATIO AND VOLTAGE COEFFICIENT ERROR

[75] Inventors: Michael K. Mayes, San Jose; Sing W. Chin, Alameda, both of Calif.

[73] Assignee: National Semiconductor Corporation, Santa Clara, Calif.

[21] Appl. No.: 396,134

[22] Filed: Feb. 28, 1995

Related U.S. Application Data

[62] Division of Ser. No. 348,737, Dec. 2, 1994, which is a division of Ser. No. 183,678, Jan. 19, 1994, abandoned.

[51] Int. Cl.[6] ..... G05F 3/16

[52] U.S. Cl. ..... 323/313

[58] Field of Search ..... 323/312, 313; 341/155, 156, 161

[56] References Cited

U.S. PATENT DOCUMENTS 4,295,089 10/1981 Cooperman ..... 323/313

5,184,061 2/1993 Lee et al. ..... 323/313

5,297,066 3/1994 Mayes ..... 364/578

*Primary Examiner*—Matthew V. Nguyen

*Attorney, Agent, or Firm*—Limbach & Limbach L.L.P.

[57] ABSTRACT

A novel ratioed reference voltage circuit is taught which enables positive and negative output voltages as a ratio of a given reference voltage. The desired ratio is established by capacitor ratios. During the operation of the circuit, positive and negative ratioed output voltages are provided at various points in time which are not necessarily very accurate due to component mismatches and the like. However, the average of the positive ratioed reference voltage during two different periods of time is a highly accurate positive ratioed reference voltage due to error cancellation. Similarly, the average of the negative ratioed reference voltage during two different periods of time is a highly accurate negative ratioed reference voltage due to error cancellation.

5 Claims, 4 Drawing Sheets

RATIOED REFERENCE VOLTAGE GENERATION USING SELF-CORRECTING CAPACITOR RATIO AND VOLTAGE COEFFICIENT ERROR

This application is a Divisional of U.S. application Ser. No. 08/348,737, filed Dec. 2, 1994, which in turn is a divisional of U.S. application Ser. No. 08/183,678, filed Jan. 19, 1994, now abandoned.

TECHNICAL FIELD

This invention pertains to electronic circuits, and more specifically to electronic circuits which are capable of generating highly accurate ratioed reference voltages.

BACKGROUND

Integrated circuits are well known and many such integrated circuits require the use of an accurate ratio of a reference voltage. An example of a widely used ratio reference voltage circuit is a resistive or capacitive ratio divider, or level shifting obtained utilizing a diode or transistor components. But such prior art ratio reference voltage circuits are limited in their accuracy due to the problem with component matching, and, at least in the case of semiconductor components, the variations due to processing parameters and operating temperatures.

SUMMARY

A novel ratioed reference voltage circuit is taught which enables positive and negative output voltages as a ratio of a given reference voltage. The desired ratio is established by capacitor ratios. During the operation of the circuit, positive and negative ratioed output voltages are provided at various points in time which are not necessarily very accurate due to component mismatches and the like. However, the average of the positive ratioed reference voltage during two different periods of time is a highly accurate positive ratioed reference voltage due to error cancellation. Similarly, the average of the negative ratioed reference voltage during two different periods of time is a highly accurate negative ratioed reference voltage due to error cancellation.

DETAILED DESCRIPTION

Figure 1A:
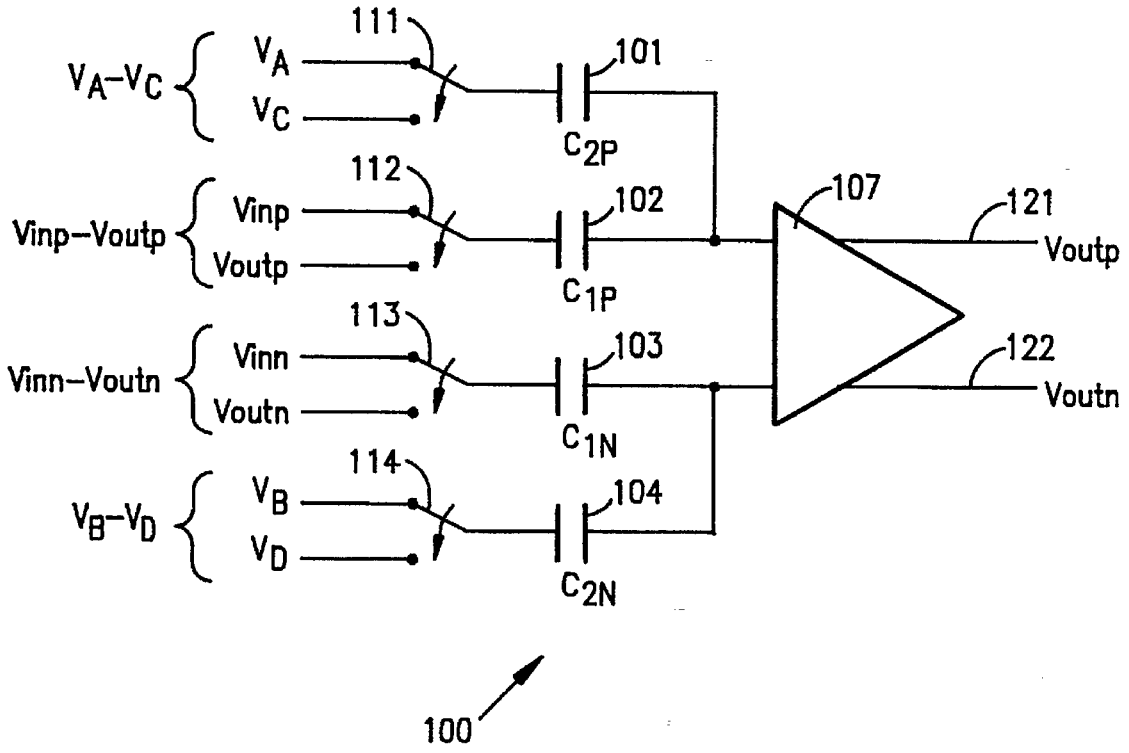
FIG. 1*a* is a diagram of a half-reference voltage generation circuit utilizing switched capacitors constructed in accordance with the teachings of this invention.

FIG. 1*a* is a schematic diagram of one embodiment of a ratioed reference voltage generation circuit 100 constructed in accordance with the teachings of this invention. Ratioed reference voltage circuit 100 of FIG. 1*a* is used in combination with a voltage selector such as an analog multiplexer which selectively applies appropriate reference voltage levels $V_A$, $V_B$, $V_C$, $V_D$, Vinp, and Vinn, to generate ratioed reference voltages Voutp and Voutn which are dependent on component ratios and voltage coefficients, and thus are not highly accurate. For purposes of the example discussed herein, it is assumed that the ratioed voltage desired is a half-reference voltage, although by appropriate selection of capacitor ratio, any desired voltage ratio can be achieved in accordance with the teachings of this invention.

Figure 1B:
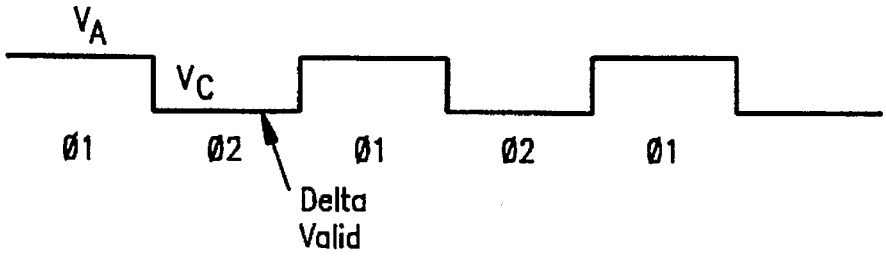
FIG. 1*b* is a timing diagram depicting a two-phase clock used to operate switches 111 through 114 of FIG. 1*a;*

FIG. 1*b* is a timing diagram depicting a control signal applied to switches 111 through 114 of circuit 100 to select the appropriate ones of the input voltages on each of those switches. For example, during a first timing phase $\phi_1$, switch 111 selects voltage $V_A$, and during a second timing period $\phi_2$, switch 111 selects voltage $V_C$. At a point after the transition from $\phi_1$ to $\phi_2$, the output voltages $V_{outp}$ and $V_{outn}$ from the half-reference circuit is valid. In operation of an analog-to-digital converter, period $\phi_2$ may correspond to a period in which an input voltage is sampled, and period $\phi_1$ may correspond to an analysis operation of a single stage of a pipelined analog-to-digital converter to provide valid digital output data.

FIG. 1*a* depicts this analog multiplexer as switches 111 through 114. Switch 111 selects input voltage $V_A$ at time $\phi_1$ and input voltage $V_C$ at time $\phi_2$ for application to one plate of capacitor 101 having a capacitance value $C_{2p}$, and whose second plate is applied to one input lead of operational amplifier 107. Similarly, switch 112 selectively applies input voltage $V_{inp}$ at time $\phi_1$ and input voltage $V_{outp}$ at time $\phi_2$ to a first plate of capacitor 102 having a capacitance value $C_{1p}$, and whose other plate is also connected to the same input lead of operational amplifier 107 as is capacitor 101. Switch 113 selectively applies input voltage $V_{inn}$ at time $\phi_1$ and input voltage $V_{outn}$ at time $\phi_2$ to a first plate of capacitor 103, having a capacitance value $C_{IN}$, and whose other plate is connected to the second input lead of operational amplifier 107. Similarly, switch 114 selectively applies input voltages $V_B$ (at time $\phi_1$) and $V_D$ (at time $\phi_2$) to a first plate of capacitor 104, having a capacitance value $C_{2N}$, whose second plate is connected to the second input lead of operational amplifier 107. Operational amplifier 107 provides on its output leads 121 and 122 output voltages $V_{outp}$ and $V_{outn}$, respectively. The voltage difference between positive half-reference output voltage Voutp and negative half-reference output voltage Voutn is equal to ±Vref/2, in my example, where Vref is the reference voltage, depending on the state of circuit 100.

Summing charge in circuit 100 and solving for output voltages Voutp and Voutn, during time period $\phi_2$, after settling, the following approximations hold true:

$$Voutp = \frac{(V_A - V_C)\cdot(1+\alpha(V_A - V_C) + \beta(V_A - V_B)^2)\cdot C_{2P}}{C_{1P}\cdot(1+\alpha(Vinp - Voutpi) + \beta(Vinp - Voutpi)^2) + \frac{1}{opampgain}} + Vinp \quad (1)$$

$$Voutn = \frac{(V_A - V_C)\cdot(1+\alpha(V_A - V_C) + \beta(V_A - V_B)^2)\cdot C_{2N}}{C_{1N}\cdot(1+\alpha(Vinn - Voutni) + \beta(Vinn - Voutni)^2) + \frac{1}{opampgain}} + Vinn \quad (2)$$

where

α=the first order voltage coefficient of capacitance values C1P, C1N, C2P, and C2N;

β=the second order voltage coefficient of capacitance values C1P, C1N, C2P, and C2N; and opampgain=the open loop gain of operational amplifier 107.

Assuming ideal conditions, i.e. α=0, β=0, opampgain=infinity, and ideal capacitor matching such that C2P=C2N and such that C1P=C1N (with these capacitor values being selected to provide a half-reference voltage output signal as a desired ratioed output voltage), then ideal values of Voutp and Voutn are given by, respectively, $$Voutpi = vinp + \frac{1}{4}\ (V_A - V_C) \tag{3}$$

$$Voutni = vinn + \frac{1}{4}\ (V_B - V_D) \tag{4}$$

Figure 1C:
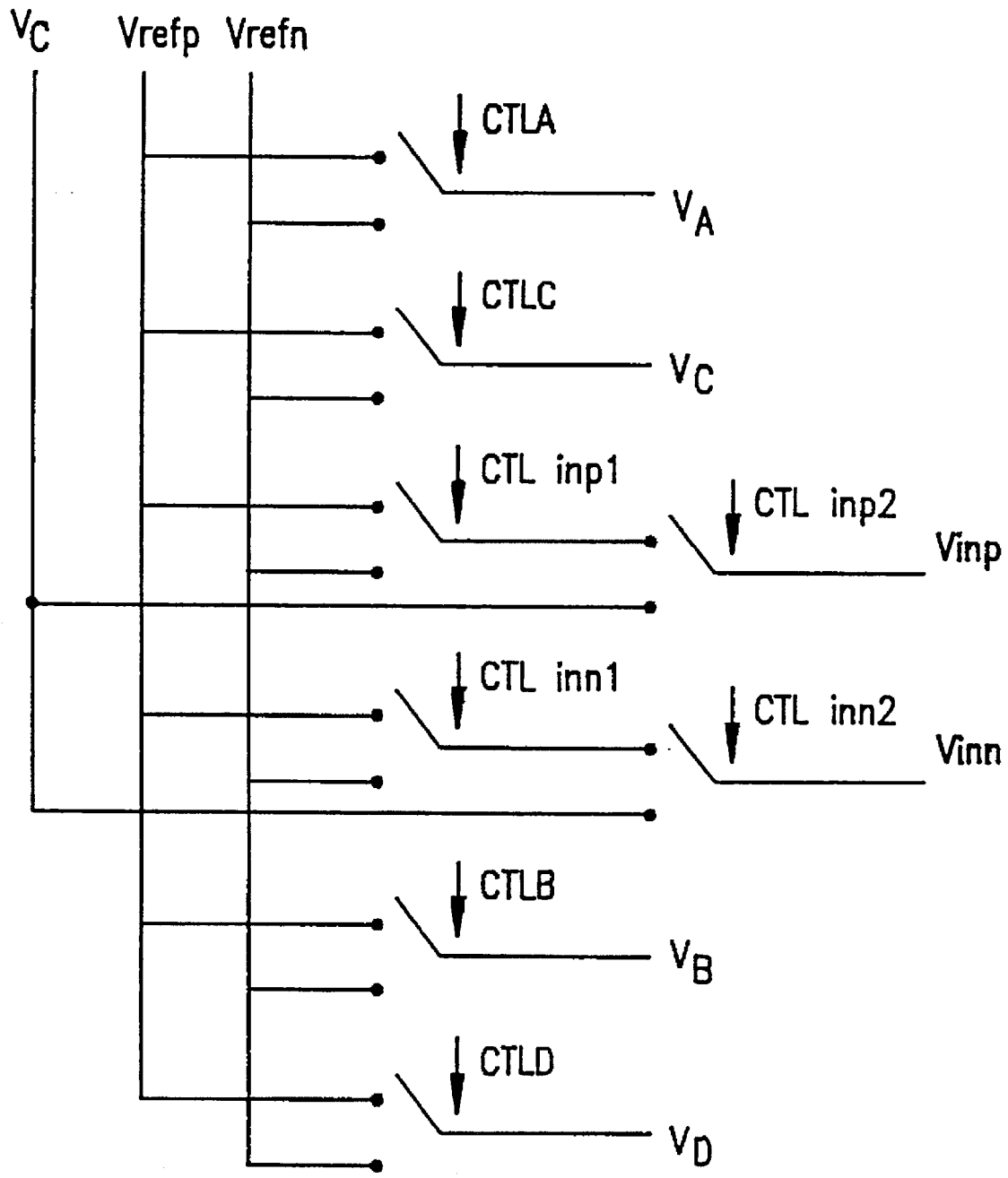
FIG. 1*c* is an example of a multiplexer circuit suitable for use in generating appropriate voltages indicated in the circuit of FIG. 1*a;*

Multiplexing various combinations of $V_A$, $V_B$, $V_C$, $V_D$, Vinp, and Vinn results in Voutp-Voutn providing values of ±Vref/2, as shown in Table 1, with a specific example shown in Table 2 for an example where Vref is 5 volts and ±Vref/2 is thus equal to ±2.5 volts. In tables 1 and 2, $V_{CM}$ is the common mode voltage of the operational amplifiers used in the analog to digital converter, which is typically approximately one half of the supply voltage. The selection and timing of the various voltage levels to be applied as input voltages to circuit 100 is performed in any convenient manner, including but not limited to table lookup, state machine operation, dedicated logic circuitry, under control of a microprocessor, or the like. For example, FIG. 1C is a circuit depicting a multiplexor suitable for selecting and applying the appropriate voltages $V_A$, $V_C$, $V_{inp}$, $V_{outp}$, $V_{inn}$, $V_{outn}$, $V_B$, and $V_D$ to switches 111 through 114 of circuit 100 of FIG. 1*a*. As such sequential operations are well known to those of ordinary skill in the art and a wide variety of such sequential operational control is possible, this application does not dwell on the specifics of this sequential operation.

TABLE 1

| $V_A$ | $V_B$ | $V_C$ | $V_D$ | Vinp | Vinn | Voutp–Voutn |
|---|---|---|---|---|---|---|
| 0 | Vref | Vref | 0 | $V_{CM}$ | $V_{CM}$ | $Vout_1$ = −Vref/2 |
| Vref | 0 | 0 | Vref | 0 | Vref | $Vout_2$ = −Vref/2 |
| 0 | Vref | Vref | 0 | Vref | 0 | $Vout_3$ = +Vref/2 |
| Vref | 0 | 0 | Vref | $V_{CM}$ | $V_{CM}$ | $Vout_4$ = +Vref/2 |

TABLE 2

(in volts)

| $V_A$ | $V_B$ | $V_C$ | $V_D$ | Vinp | Vinn | Voutp–Voutn |
|---|---|---|---|---|---|---|
| 0 | 5 | 5 | 0 | $V_{CM}$ | $V_{CM}$ | $Vout_1$ = −2.5 |
| 5 | 0 | 0 | 5 | 0 | 5 | $Vout_2$ = −2.5 |
| 0 | 5 | 5 | 0 | 5 | 0 | $Vout_3$ = +2.5 |
| 5 | 0 | 0 | 5 | $V_{CM}$ | $V_{CM}$ | $Vout_4$ = +2.5 |

Figure 2:
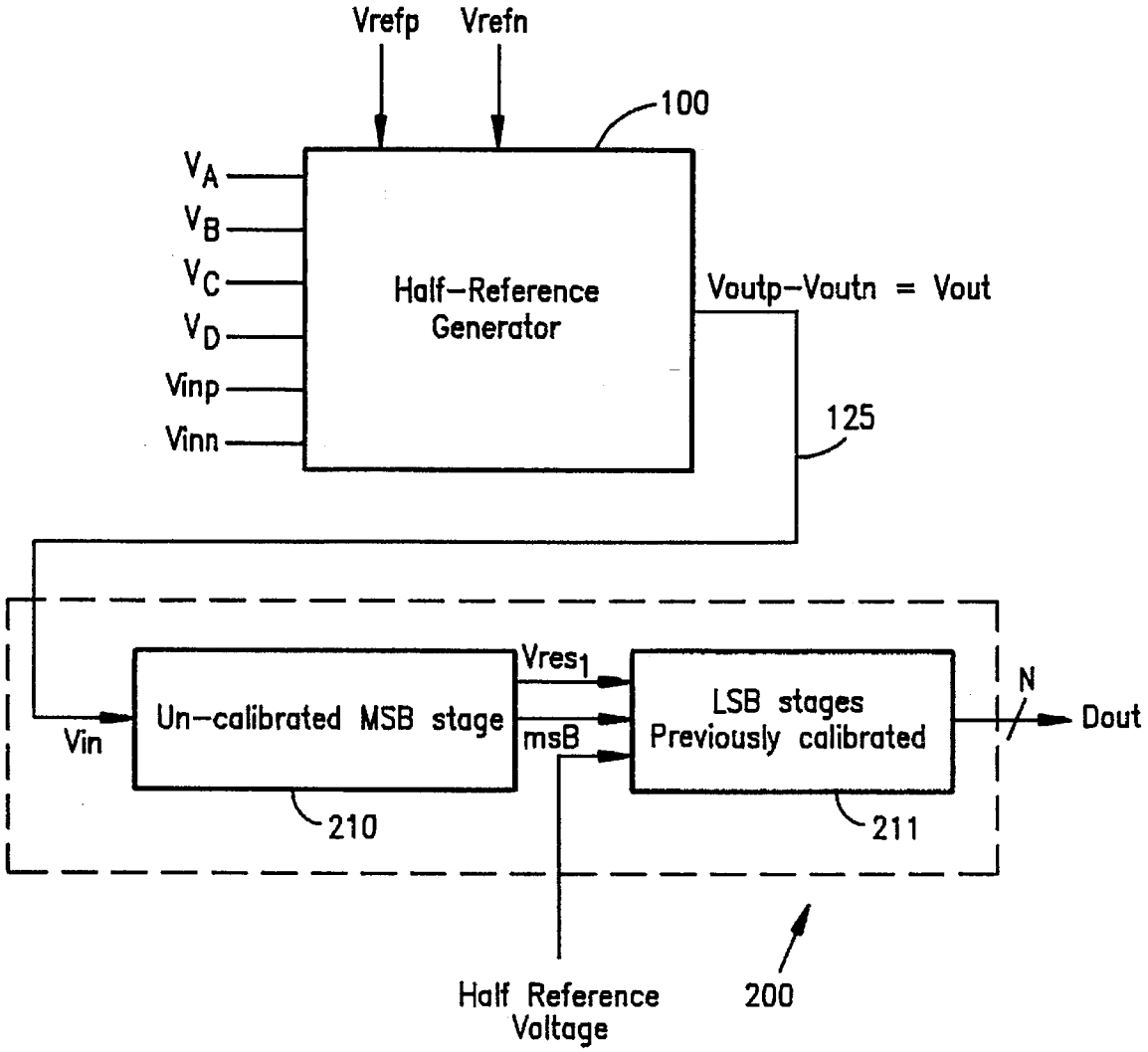
FIG. 2 is a block diagram depicting the half-reference generator of FIG. 1 shown in combination with an analog-to-digital converter stage for providing calibration using the half-reference voltage generator circuit.

The above values are applied sequentially to the input of a pipelined analog to digital converter (ADC) 200, as depicted in the exemplary block diagram of FIG. 2. The common mode voltage $V_{CM}$ is cancelled due to the fact that the analog-to-digital converter is fully differential. Such pipelined ADCs are well known in the art, although a particularly accurate ADC is disclosed in copending U.S. patent application Ser. No. 08/183,629 and assigned to National Semiconductor Corporation (Docket Number NS-2265), and which receives a highly accurate half-reference voltage ±Vref/2 in order to perform second order voltage coefficient calibration or, as is provided by the present invention, an average of $Vout_1$ and $Vout_2$ which average is a highly accurate −Vref/2, and an average of $Vout_3$ and $Vout_4$, which average is a highly accurate +Vref/2. As shown in FIG. 2, half-reference generator 100 applies via lead 125 a value Voutp-Voutn as an input voltage to ADC 200. ADC 200 is shown having an uncalibrated most significant bit (MSB) stage 210, and a plurality of previously calibrated LSB stages 211. These LSB stages 211 are calibrated sequentially using +Vref/2 and −Vref/2 as their input voltages, for example to calibrate a desired number of LSB stages 211, such as is described in the aforementioned copending U.S. patent application Ser. No. 08/183,629. As a result of the ADC operation performed by ADC 200, the uncalibrated MSB stage provides a most significant bit and a residual voltage $Vres_1$ to the LSB stages 211, which in turn provide a plurality of digital bits which, when combined with the digital bit provided by MSB stage 210, provides an n bit digital output word Dout providing a digital representation of the analog input voltage Vin. For each value of Voutp-Voutn, an analog to digital conversion is performed. Ideally, for a 16 bit ADC using a reference voltage of 5 volts, $$Dout = output(-Vref/2)\ for\ Vin = -Vref/2$$

and thus $$Dout = 16384\ for\ Vin = -2.5\ volts \tag{5}$$

and $$ADC = 16\ bits$$

where output(Vin) is the digital representation provided for an input voltage Vin to ADC 200.

$$Dout = output(+Vref/2)\ for\ Vin = -Vref/2$$

and thus $$Dout = 49152\ for\ Vin = +2.5 \tag{6}$$

and $$ADC = 16\ bits$$

However, $E_1$ and $E_2$ are second order errors within the analog-to-digital converter caused by the capacitor voltage coefficient.

For each value of Vout=Voutp-Voutn, its digital representation Dout is the combination of a base (output(−Vref/2) and output(+Vref/2), or 16384 and 49152, respectively, when Vref=5 volts and ADC 200 is a 16 bit ADC, by way of example), the voltage coefficient error for MSB stage 210 ($E_1$ and $E_2$) and errors $A_1$, $A_2$, $A_3$, and $A_4$ due to all non-ideal effects of the half-reference voltage circuit of FIG. 1*a*. Thus, in the general case and for an ADC of 16 bits, respectively:

$$Dout_1 = output(-Vref/2) + E_1 + A_1\ for\ Vin = -Vref/2\ Dout_1 = 16384 + E_1 + A_1\ for\ Vin = -2.5 \tag{7}$$

$$Dout_2 = output(-Vref/2) + E_1 + A_2\ for\ Vin = -Vref/2\ Dout_2 = 16384 + E_1 + A_2 for\ Vin = -2.5 \tag{8}$$

$$Dout_3 = output(+Vref/2) + E_2 + A_3\ for\ Vin = +Vref/2\ Dout_3 = 49152 + E_2 + A_3\ \text{for Vin} = +2.5 \tag{9}$$

$$Dout_4 = output(+Vref/2) + E_2 + A_4\ for\ Vin = +Vref/2\ Dout_4 = 49152 + E_2 + A_4\ for\ Vin = +2.5 \tag{10}$$

Combining equations (1) and (2) with the non-ideal effects of MSB stage 210 and ideal LSB stages 211 yields, for a specific example having a 10 ppm capacitor voltage coefficient and 0.1% capacitor mismatches:

$Dout_1$=16353.4 LSB units (for Vin=−2.5 volts)
$Dout_2$=16418.57 LSB units (for Vin=−2.5 volts)
$Dout_3$=49117.5 LSB units (for Vin=+2.5 volts)
$Dout_4$=49182.6 LSB units (for Vin=+2.5 volts).

Figure 3:
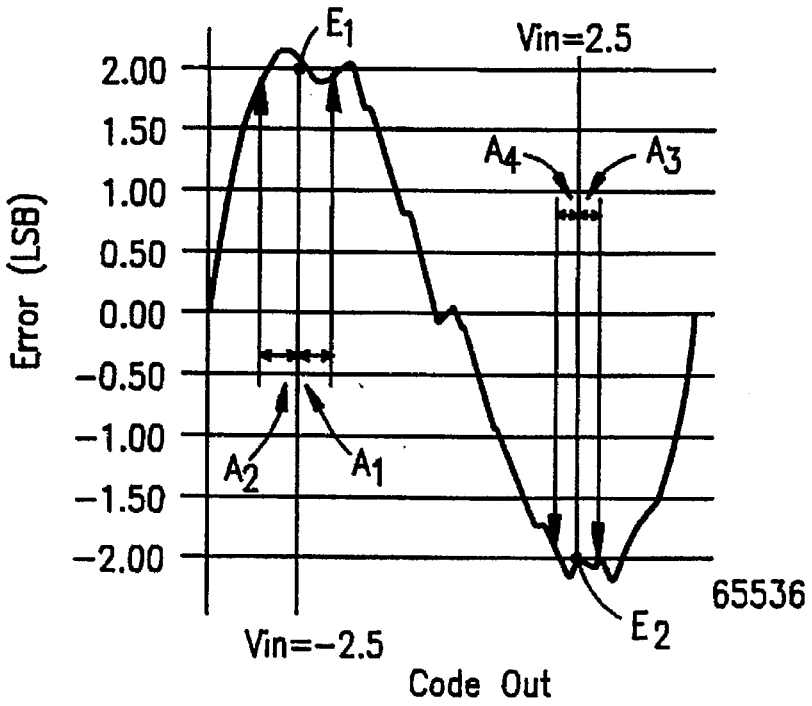
FIG. 3 is a graph depicting the linearity of an analog-to-digital converter without the second order coefficient calibration, buffer correction for gain and offset errors.

The values of Vin=−Vref/2 and Vin=+Vref/2 used for calibration are symmetrical about their ideal values of Vin=±Vref/2, as shown in FIG. 3 for the specific example where Vref=5 volts.

Independent of capacitor mismatch, operational amplifier gain, charge injection, and voltage coefficient, the values of $E_1$ and $E_2$ can be isolated from all other non-ideal effects by averaging the two measurements taken for each value of Dout corresponding to ±Vref/2, respectively:

$$E_1 = \frac{Dout_1 + Dout_2}{2} - \text{output}(Vref/2) \tag{11}$$

$$E_2 = \frac{Dout_3 - Dout_4}{2} + \text{output}(Vref/2) \tag{12}$$

Figure 4:
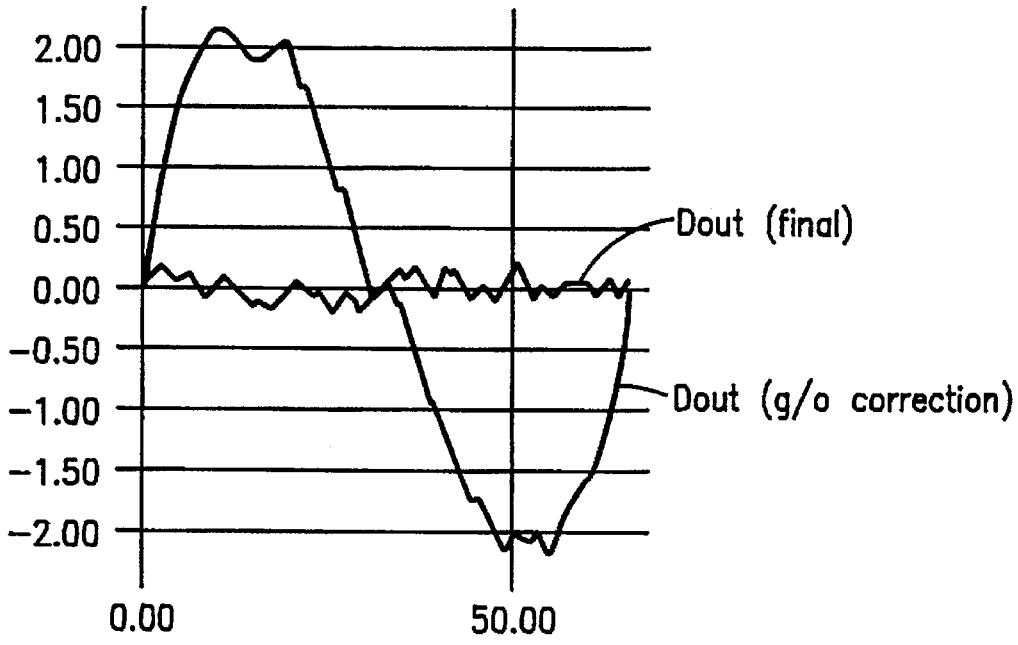
FIG. 4 is a graph depicting the improvement in analog to digital converter accuracy as a result of the second order calibration feature achieved using the highly acccurate ratioed reference voltage provided by the present invention.

Therefore, solving equations (11) and (12) for the specific examples of $Dout_1$ through $Dout_4$ given above yields $E_1$=+2LSB, and $E_2$=−2LSB as seen from FIG. 3. This result is equivalent to a single measurement taken with ideal values of ±Vref/2. Applying $E_l$ and $E_2$ to the circuit of FIG. 2 results in an 18-bit accurate 16-bit ADC, as described more fully in the aforementioned copending U.S. patent application. FIG. 4 is a graph depicting a first curve Dout(g/o correction) showing a rather significant second order voltage coefficient existing after gain and offset calibration as taught by the aforementioned copending application, but prior to second order calibration. The second curve Dout(final) of FIG. 4 shows the much improved second order voltage coefficient resulting from second order calibration achieved using the highly accurate ratioed reference voltages as provided by this invention.

All publications and patent applications mentioned in his specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A ratioed reference voltage circuit with $V_{ref}$ as an input voltage reference, the circuit comprising:

a voltage selector having a plurality of voltage selector inputs and a plurality of voltage selector outputs for applying a first voltage to a corresponding voltage selector output during a time period $\phi_1$, and applying a second voltage to a corresponding voltage selector output during a following time period $\phi_2$, wherein the voltage applied to one voltage selector output during any time period is not necessarily the same as the voltage applied to another voltage selector output;

an amplifier having a plurality of inputs and a differential voltage output; and a plurality of sets of capacitances, each set of capacitances coupling an associated one of the voltage selector outputs to an associated one of the plurality of inputs of the amplifier and having a value such that the electrical combination of the voltages and capacitances provides a voltage level of $\pm V_{ref}/m$, where m is any desired number, at the differential output of the amplifier.

2. A ratioed reference voltage circuit as in claim 1 wherein the voltage selector comprises a multiplexor.

3. A ratioed reference voltage circuit as in claim 1 wherein m is 2.

4. A ratioed reference voltage circuit as in claim 1 wherein the voltage level applied to the corresponding voltage selector output is selected from the group comprising $V_{ref}$, 0, and $V_{CM}$, where $V_{CM}$ is a common-mode voltage.

5. A ratioed reference voltage circuit as in claim 1 wherein:

the voltage selector comprises eight voltage selector inputs and four voltage selector outputs, wherein four of the voltage selector inputs correspond to a first amplifier input via two voltage selector outputs and the other four voltage selector inputs correspond to a second amplifier input via the other two voltage selector outputs, with each voltage selector output corresponding to a pair of voltage selector inputs; and the capacitance set associated with each voltage selector output is coupled in series between the voltage selector output and its associated one of the first and second amplifier inputs.

* * * * *